US010364613B1

(12) United States Patent
Sani et al.

(10) Patent No.: US 10,364,613 B1
(45) **Date of Patent: *Jul. 30, 2019**

(54) POLYCRYSTALLINE DIAMOND COMPACT INCLUDING A NON-UNIFORMLY LEACHED POLYCRYSTALLINE DIAMOND TABLE AND APPLICATIONS THEREFOR

(71) Applicant: US SYNTHETIC CORPORATION, Orem, UT (US)

(72) Inventors: Mohammad N. Sani, Berkshire (GB); Andrew E. Dadson, Provo, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/862,831

(22) Filed: Jan. 5, 2018

Related U.S. Application Data

(63) Continuation of application No. 14/505,171, filed on Oct. 2, 2014, now Pat. No. 9,890,596, which is a (Continued)

(51) Int. Cl.
*E21B 10/55* (2006.01)
*B24D 99/00* (2010.01)
*B24D 3/06* (2006.01)

(52) U.S. Cl.
CPC ..... *E21B 10/55* (2013.01); *B24D 3/06* (2013.01); *B24D 99/005* (2013.01)

(58) Field of Classification Search
CPC combination set(s) only.
See application file for complete search history.

(56) References Cited

U.S. PATENT DOCUMENTS 4,268,276 A 5/1981 Bovenkerk
4,410,054 A 10/1983 Nagel et al.
(Continued)

FOREIGN PATENT DOCUMENTS

WO WO 2012/145586 10/2012

OTHER PUBLICATIONS

U.S. Appl. No. 61/248,951, filed Oct. 6, 2009, Sani et al.
(Continued)

*Primary Examiner* — Cathleen R Hutchins
*Assistant Examiner* — Ronald R Runyan
(74) *Attorney, Agent, or Firm* — Dorsey & Whitney LLP

(57) ABSTRACT

In an embodiment, a polycrystalline diamond compacts ("PDC") includes a substrate and a polycrystalline diamond ("PCD") table bonded to the substrate. The PCD table defines an upper surface and at least one peripheral surface. The PCD table includes a plurality of bonded diamond grains. The PCD table includes a first region adjacent to the substrate that includes a metallic constituent disposed interstitially between the bonded diamond grains thereof, and a leached second region extending inwardly from the upper surface and the at least one peripheral surface that is depleted of the metallic constituent. The leached second region exhibits a leach depth profile having a maximum leach depth that is measured from the upper surface. A leach depth of the leach depth profile decreases with lateral distance from a central axis of the PCD table and toward the at least one peripheral surface.

33 Claims, 7 Drawing Sheets

Related U.S. Application Data continuation of application No. 14/060,272, filed on Oct. 22, 2013, now Pat. No. 8,925,655, which is a continuation of application No. 12/898,047, filed on Oct. 5, 2010, now Pat. No. 8,596,387.

(60) Provisional application No. 61/248,951, filed on Oct. 6, 2009.

(56) References Cited

U.S. PATENT DOCUMENTS

| | | | |
|---|---|---|---|
| 4,468,138 | A | 8/1984 | Nagel |
| 4,560,014 | A | 12/1985 | Geczy |
| 4,738,322 | A | 4/1988 | Hall et al. |
| 4,811,801 | A | 3/1989 | Salesky et al. |
| 4,913,247 | A | 4/1990 | Jones |
| 5,016,718 | A | 5/1991 | Tandberg |
| 5,092,687 | A | 3/1992 | Hall |
| 5,120,327 | A | 6/1992 | Dennis |
| 5,135,061 | A | 8/1992 | Newton, Jr. |
| 5,154,245 | A | 10/1992 | Waldenstrom et al. |
| 5,364,192 | A | 11/1994 | Damm et al. |
| 5,368,398 | A | 11/1994 | Damm et al. |
| 5,437,343 | A | 8/1995 | Cooley et al. |
| 5,460,233 | A | 10/1995 | Meany et al. |
| 5,480,233 | A | 1/1996 | Cunningham |
| 5,544,713 | A | 8/1996 | Dennis |
| 6,601,662 | B2 | 8/2003 | Matthias et al. |
| 6,793,681 | B1 | 9/2004 | Pope et al. |
| 7,350,601 | B2 | 4/2008 | Belnap et al. |
| 7,533,740 | B2 | 5/2009 | Zhang et al. |
| 8,596,387 | B1 | 12/2013 | Sani et al. |
| 8,925,655 | B1 | 1/2015 | Sani et al. |
| 9,890,596 | B1 * | 2/2018 | Sani ..... E21B 10/55 |
| 2005/0230156 | A1 | 10/2005 | Belnap et al. |
| 2006/0157285 | A1 | 7/2006 | Cannon et al. |
| 2006/0266559 | A1 | 11/2006 | Keshavan et al. |
| 2008/0142276 | A1 | 6/2008 | Griffo et al. |

OTHER PUBLICATIONS

U.S. Appl. No. 12/185,457, filed Aug. 4, 2008, Vail et al.
U.S. Appl. No. 12/898,047, filed Oct. 5, 2010, Sani et al.
U.S. Appl. No. 14/060,272, filed Oct. 22, 2013, Sani et al.
U.S. Appl. No. 14/505,171, filed Oct. 2, 2014, Sani et al.
B 886-03—Standard Test Method for Determination of Magnetic Saturation (Ms) of Cemented Carbides 2 pgs / ASTM International (Reapproved 2008).
B 887-03—Standard Test Method for Determination of Coercivity (Hcs) of Cemented Carbides 2 pgs / ASTM International (Reapproved 2008).
U.S. Appl. No. 12/898,047, Dec. 20, 2012, Office Action.
U.S. Appl. No. 12/898,047, Jul. 23, 2013, Notice of Allowance.
U.S. Appl. No. 12/898,047, Nov. 13, 2013, Issue Notification.
U.S. Appl. No. 14/060,272, Apr. 11, 2014, Office Action.
U.S. Appl. No. 14/060,272, Sep. 4, 2014, Notice of Allowance.
U.S. Appl. No. 14/060,272, Dec. 17, 2014, Issue Notification.
U.S. Appl. No. 14/505,171, Jan. 23, 2017, Office Action.
U.S. Appl. No. 14/505,171, Jul. 21, 2017, Office Action.
U.S. Appl. No. 14/505,171, Oct. 6, 2017, Notice of Allowance.
U.S. Appl. No. 14/505,171, Jan. 24, 2018, Issue Notification.

* cited by examiner

POLYCRYSTALLINE DIAMOND COMPACT INCLUDING A NON-UNIFORMLY LEACHED POLYCRYSTALLINE DIAMOND TABLE AND APPLICATIONS THEREFOR

CROSS-REFERENCE TO RELATED APPLICATION

This application is a continuation of U.S. application Ser. No. 14/505,171 filed 2 Oct. 2014, which is a continuation of U.S. application Ser. No. 14/060,272 filed on 22 Oct. 2013 (now U.S. Pat. No. 8,925,655 issued on 6 Jan. 2015), which is a continuation of U.S. application Ser. No. 12/898,047 filed on 5 Oct. 2010 (now U.S. Pat. No. 8,596,387 issued on 3 Dec. 2013), which claims the benefit of U.S. Provisional Application No. 61/248,951 filed on 6 Oct. 2009. Each of the foregoing applications is incorporated herein, in its entirety, by this reference.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process. The PDC cutting element may be brazed directly into a preformed pocket, socket, or other receptacle formed in a bit body. The substrate may often be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container with a volume of diamond particles positioned on a surface of the cemented carbide substrate. A number of such containers may be loaded into an HPHT press. The substrate(s) and volume(s) of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In one conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a metal-solvent catalyst to promote intergrowth between the diamond particles, which results in formation of a matrix of bonded diamond grains having diamond-to-diamond bonding therebetween. Interstitial regions between the bonded diamond grains are occupied by the metal-solvent catalyst.

The presence of the metal-solvent catalyst in the PCD table is believed to reduce the thermal stability of the PCD table at elevated temperatures experienced during drilling of a subterranean rock formation. For example, the difference in thermal expansion coefficient between the diamond grains and the metal-solvent catalyst is believed to lead to chipping or cracking of the PCD table during drilling or cutting operations, which consequently can degrade the mechanical properties of the PCD table or cause failure. Additionally, some of the diamond grains can undergo a chemical breakdown or back-conversion to graphite via interaction with the metal-solvent catalyst.

One conventional approach for improving the thermal stability of PDCs is to at least partially remove the metal-solvent catalyst from the PCD table of the PDC by acid leaching. Despite the availability of a number of different PDCs, manufacturers and users of PDCs continue to seek improved thermally stable PDCs.

SUMMARY

Embodiments of the invention relate to PDCs including a non-uniformly leached PCD table exhibiting a desirable combination of edge-impact resistance and thermal stability, and methods of fabricating such PDCs. In an embodiment, a PDC includes a substrate and a PCD table bonded to the substrate. The PCD table defines an upper surface and at least one peripheral surface. The PCD table includes a plurality of bonded diamond grains defining a plurality of interstitial regions. The PCD table further includes a first region adjacent to the substrate that includes metal-solvent catalyst disposed interstitially between the bonded diamond grains thereof, and a leached second region extending inwardly from the upper surface and the at least one peripheral surface that is depleted of the metal-solvent catalyst. The leached second region exhibits a leach depth profile having a maximum leach depth that is at least about 300 μm as measured from the upper surface. A leach depth of the leach depth profile decreases with lateral distance from a central axis of the PCD table and toward the at least one peripheral surface.

In an embodiment, a method of fabricating a leached PDC is disclosed. The method includes providing a PDC. The PDC includes a substrate and a PCD table bonded to the substrate. The PCD table defines an upper surface and at least one peripheral surface. The PCD table includes a plurality of bonded diamond grains defining a plurality of interstitial regions. The PCD table further includes metal-solvent catalyst disposed interstitially between at least a portion of the bonded diamond grains thereof. The method further includes leaching the metal-solvent catalyst from a region of the PCD table so that the region is depleted of metal-solvent catalyst to a maximum leach depth that is greater than about 300 μm as measured from the upper surface. A leach depth of the region decreases with lateral distance from a central axis of the PCD table and toward the at least one peripheral surface.

In an embodiment, a PDC includes a substrate and a pre-sintered PCD table bonded to the substrate. The pre-sintered PCD table defines an upper surface and at least one peripheral surface. The pre-sintered PCD table includes a plurality of bonded diamond grains defining a plurality of interstitial regions. The pre-sintered PCD table further includes a first region adjacent to the substrate that includes metal-solvent catalyst disposed interstitially between the bonded diamond grains thereof, and a leached second region extending inwardly from the upper surface and the at least one peripheral surface that is depleted of the metal-solvent catalyst. The leached second region exhibits a leach depth profile having a maximum leach depth that is at least about 250 μm as measured from the upper surface. A leach depth of the leach depth profile decreases with lateral distance from a central axis of the pre-sintered PCD table and toward the at least one peripheral surface.

In an embodiment, a method of fabricating a leached PDC is disclosed. The method includes providing a PDC. The PDC includes a substrate and a pre-sintered PCD table bonded to the substrate. The pre-sintered PCD table defines an upper surface and at least one peripheral surface. The pre-sintered PCD table includes a plurality of bonded diamond grains defining a plurality of interstitial regions. The pre-sintered PCD table further includes metal-solvent catalyst disposed interstitially between at least a portion of the bonded diamond grains thereof. The method further includes leaching the metal-solvent catalyst from a region of the pre-sintered PCD table so that the region is depleted of metal-solvent catalyst to a maximum leach depth that is greater than about 250 μm as measured from the upper surface. A leach depth of the region decreases with lateral distance from a central axis of the pre-sintered PCD table and toward the at least one peripheral surface.

Other embodiments include applications utilizing the disclosed PDCs in various articles and apparatuses, such as rotary drill bits, bearing apparatuses, wire-drawing dies, machining equipment, and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical elements or features in different views or embodiments shown in the drawings.

DETAILED DESCRIPTION

Embodiments of the invention relate to PDCs including a non-uniformly leached PCD table exhibiting a desirable combination of edge-impact resistance and thermal stability, and methods of fabricating such PDCs. The disclosed PDCs may be used in a variety of applications, such as rotary drill bits, bearing apparatuses, wire-drawing dies, machining equipment, and other articles and apparatuses.

Figure 1A:
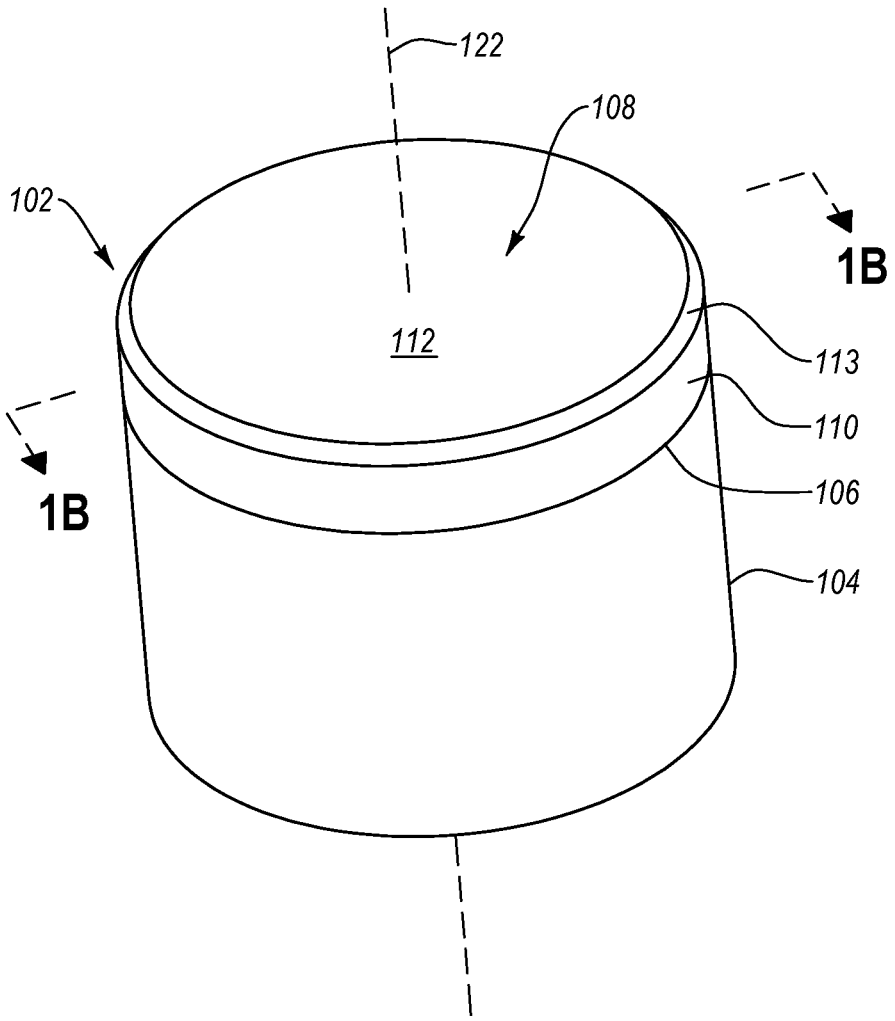
FIG. 1A is an isometric view of an embodiment of a PDC including a PCD table exhibiting a selected leach depth profile.
Figure 1B:
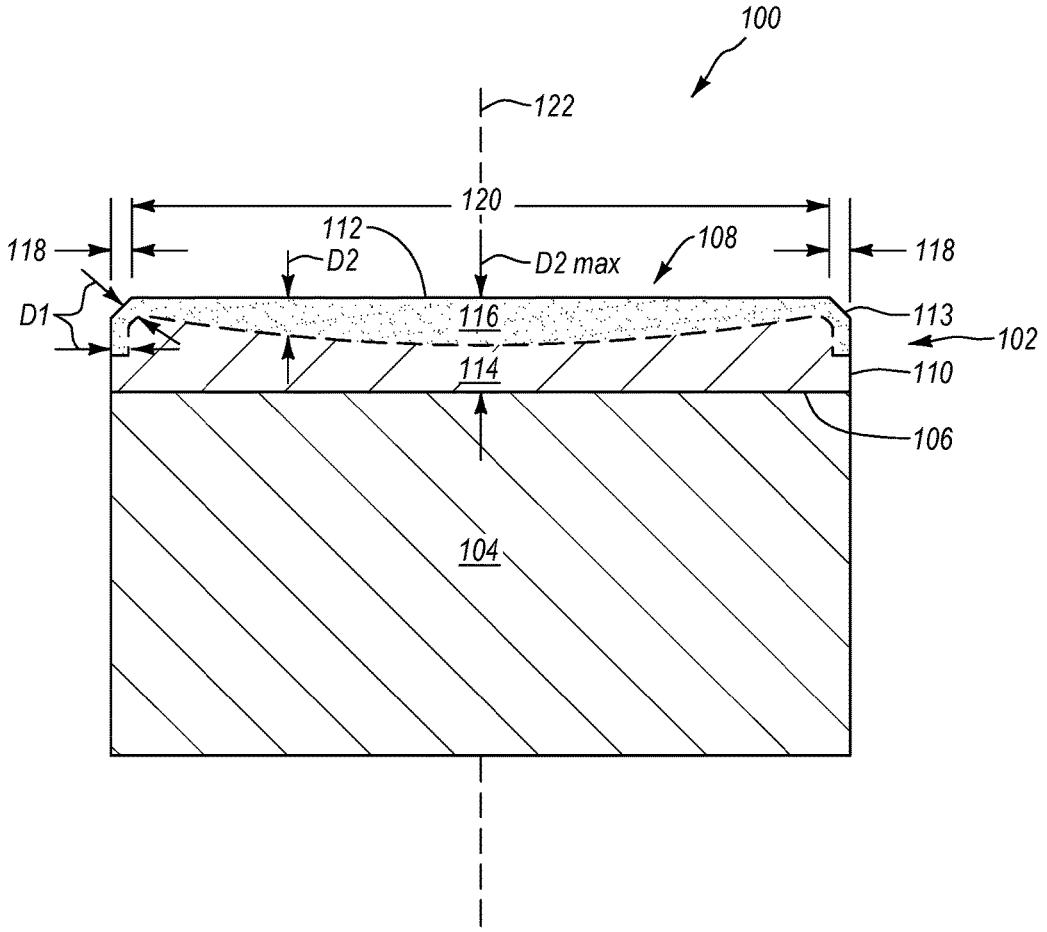
FIG. 1B is a cross-sectional view of the PDC shown in FIG. 1A taken along line 1B-1B.

FIGS. 1A and 1B are isometric and cross-sectional views, respectively, of an embodiment of a PDC 100 including a PCD table 102 exhibiting a selected non-uniform leach depth profile that provides a desirable combination of edge-impact resistance and thermal stability. The PDC 100 includes a substrate 104 having an interfacial surface 106. For example, the substrate 104 may comprise a cemented carbide substrate, such as tungsten carbide, tantalum carbide, vanadium carbide, niobium carbide, chromium carbide, titanium carbide, or combinations of the foregoing carbides cemented with iron, nickel, cobalt, or alloys thereof. In an embodiment, the cemented carbide substrate may comprise a cobalt-cemented tungsten carbide substrate. The interfacial surface 106 of the substrate 104 is bonded to the PCD table 102. In the illustrated embodiment, the interfacial surface 106 is substantially planar. However, in other embodiments, the interfacial surface 106 may exhibit a selected nonplanar topography.

The PCD table 102 includes a plurality of directly bonded-together diamond grains exhibiting diamond-to-diamond bonding (e.g., $sp^3$ bonding) therebetween. The plurality of directly bonded-together diamond grains defines a plurality of interstitial regions. The PCD table 102 defines a working upper surface 108 and peripheral surface 110. In the illustrated embodiment, the upper surface 108 includes a substantially planar major surface 112 and a peripherally-extending chamfer 113 that extends between the peripheral surface 110 and the major surface 112.

The PCD table 102 includes a first region 114 adjacent and bonded to the interfacial surface 106 of the substrate 104. Metal-solvent catalyst infiltrated from the substrate 104 during HPHT processing occupies the interstitial regions of the first region 114 of the PCD table 102. For example, the metal-solvent catalyst may be cobalt from a cobalt-cemented tungsten carbide substrate that infiltrated into the first region 114. The PCD table 102 includes a leached second region 116 remote from the substrate 104 that includes the major surface 112, chamfer 113, and a portion of the peripheral surface 110.

The leached second region 116 has been leached to deplete the metal-solvent catalyst therefrom that used to occupy the interstitial regions between the bonded diamond grains of the leached second region 116. The leaching may be performed in a suitable acid (e.g., aqua regia, nitric acid, hydrofluoric acid, or combinations thereof) so that the leached second region 116 is substantially free of metal-solvent catalyst. For example, the amount of the metal-solvent catalyst remaining in the leached second region 116 after leaching may be about 0 to about 3 weight % ("wt %"), such as about 0.7 wt % to about 1.0 wt %. As a result of the metal-solvent catalyst being depleted from the leached second region 116, the leached second region 116 is relatively more thermally stable that the underlying first region 114.

Referring now specifically to FIG. 1B, the leached second region 116 exhibits a non-uniform leach depth that provides a desirable combination of edge-impact resistance and thermal stability. The leach depth varies with radial distance from a centerline 122 of the PDC 100 and toward the peripheral surface 110.

The leached second region 116 includes a peripheral region 118 that extends inwardly from the chamfer 113 and the peripheral surface 110. The peripheral region 118 extends about a non-peripheral region 120 that extends inwardly from the major surface 112. For example, the non-peripheral region 120 may be generally centrally located in the PCD table 102, with the peripheral region 118 extending thereabout. The leach depth in the peripheral region 118 is indicated by D1 and measured inwardly from the chamfer 113 and/or the peripheral surface 110. The leach depth in the non-peripheral region 120 is indicated by D2 and measured inwardly from the major surface 112. The maximum leach depth for the leach depth D1 in the peripheral region 118 may be about 5 percent to about 60 percent, about 5 percent to about 50 percent, about 25 percent to about 50 percent, about 5 percent to about 15 percent, or about 8 percent to about 12 percent less than a maximum leach depth $D2_{max}$ for the leach depth D2 in the non-peripheral region 120. The maximum leach depth $D2_{max}$ for the leach depth D2 in the non-peripheral region 120 may be, in some embodiments, generally centrally located as illustrated. The shallower leach depth D1 and higher metal-solvent catalyst content in the peripheral region 118 may provide a more impact-resistant edge region for the PCD table 102, while still also providing sufficient thermal stability. The non-peripheral region 120 extends along substantially all of or a majority of the major surface 112. The portion of the major surface 112 partially defining the non-peripheral region functions predominantly as the working surface when cutting a subterranean formation, and benefits from the deeper average leach depth D2 in the non-peripheral region 120 that imparts enhanced thermal stability to the non-peripheral region 120 relative to the peripheral region 118.

While the leach depth profile illustrated in FIG. 1B is substantially symmetric about a central axis 122 of the PDC 100 or a plane of symmetry that includes the central axis 122, the leach depth profile may be asymmetric about the central axis 122 in other embodiments. For example, a maximum leach depth for the leach depth D1 on one side of the central axis 122 or the plane of symmetry may be about 5 to about 15 percent less than a maximum leach depth for the leach depth D1 on the other side of the central axis 122.

Although the leach depth D2 is illustrated as decreasing gradually with radial distance from the central axis 122 in FIG. 1B, in other embodiments, the leach depth D2 may vary more rapidly. For example, the leach depth D2 may decrease more rapidly with radial distance from the central axis 122 proximate to the peripheral region 118 of the leached second region 116 than in the illustrated embodiment shown in FIG. 1B.

In an embodiment, the PCD table 102 may be formed on the substrate 104 (i.e., integrally formed with the substrate 104) by HPHT sintering diamond particles on the substrate 104. In such an embodiment, a maximum leach depth $D2_{max}$ for the leach depth D2 of the non-peripheral region 120 may be at least about 300 μm. For example, the maximum leach depth $D2_{max}$ for the leach depth D2 of the non-peripheral region 120 may be greater than 300 μm to about 425 μm, greater than 350 μm to about 400 μm, greater than 350 μm to about 375 μm, or about 375 μm to about 400 μm, while a maximum leach depth for the leach depth D1 of the peripheral region 118 may be greater than 150 μm to about 225 μm, about 175 μm to about 225 μm, about 200 μm to about 225 μm, about 150 μm to about 185 μm, or about 150 μm to about 175 μm. The leach depth profile for the leached second region 116 may exhibit any of the foregoing ranges for the leach depth D1 combined with any of the foregoing ranges for the leach depth D2 provided that the maximum and/or average leach depth D1 is less than the maximum and/or average leach depth D2.

In an embodiment, the PCD table 102 may be a pre-sintered PCD table, such as an at least partially leached PCD table that is bonded to the substrate 104 in an HPHT process by infiltration of metal-solvent catalyst therein from the substrate 104 or other source that is subsequently leached therefrom. In such an embodiment, a maximum leach depth $D2_{max}$ for the leach depth D2 of the non-peripheral region 120 may be at least about 250 μm. For example, the maximum leach depth $D2_{max}$ for the leach depth D2 of the non-peripheral region 120 may be greater than 250 μm to about 400 μm, greater than 250 μm to about 350 μm, greater than 250 μm to about 300 μm, or greater than 250 μm to about 275 μm, while a maximum leach depth for the leach depth D1 of the peripheral region 118 may be about 175 μm to about 300 μm, about 200 μm to about 300 μm, about 215 μm to about 275 μm, about 250 μm to about 300 μm, or about 300 μm to about 325 μm. The leach depth profile for the leached second region 116 may exhibit any of the foregoing ranges for the leach depth D1 combined with any of the foregoing ranges for the leach depth D2 provided that the maximum and/or average leach depth D1 is less than the maximum and/or average leach depth D2. Additionally, when the PCD table 102 is a pre-sintered PCD table, the pre-sintered PCD table may exhibit any of the leach depth profiles previously described for the embodiment when the PCD table 102 is integrally formed with the substrate 104.

In an embodiment, prior to forming the leached second region 116, the chamfer 113 may be formed using an abrasive grinding process (e.g., grinding via a diamond-resin-bonded abrasive wheel) and the major surface 112 may be planarized using a relatively less aggressive material removal process, such as lapping in a diamond slurry. The peripheral surface 110 may be defined using a centerless abrasive grinding process or other suitable grinding process. The abrasive grinding process used to form the chamfer 113 and grind the peripheral surface 110 may tend to fracture some of the diamond grains and/or the abrasive wheel and embed the fractured material in the metal-solvent catalyst. The less aggressive lapping process that may be used to form the major surface 112 does not tend to fracture the diamond grains and/or the abrasive wheel. It is currently believed by the inventors that the fractured material embedded in the metal-solvent catalyst may inhibit removal of the metal-solvent catalyst in the peripheral region 118 compared to the non-peripheral region 120 so that the maximum and/or average leach depth D1 of the peripheral region 118 is less than that of the maximum and/or average leach depth D2 in the non-peripheral region 120.

It is also currently believed by the inventors that as pressure employed in the HPHT process used to fabricate the PCD table 102 and/or the PDC 100 increases to about 7.5 GPa or more, the volume of diamond present in the peripheral region 118 of the PCD table 102 may be greater than the volume of diamond in the non-peripheral region 120. In addition to or as an alternative to the fractured material inhibiting removal of the metal-solvent catalyst from the peripheral region 118 of the PCD table 102, this increased diamond volume in the peripheral region 118 may contribute to the non-uniformity of the leach depth profile of the leached second region 116 of the PCD table 102.

In some embodiments, the maximum and/or average leach depth D1 of a side section of the peripheral region 118 that extends inwardly from the peripheral surface may be greater than the maximum and/or average leach depth D1 of a chamfer section of the peripheral region 118 that extends inwardly from the chamfer 113. For example, the maximum and/or average leach depth D1 of the side section may be about 2 percent to about 5 percent greater than the maximum and/or average leached depth D1 of the chamfer section. The maximum and/or average leach depth D1 of the side section may increase when the grinding process used to define the peripheral surface 110 is substantially less aggressive than the grinding process used to form the chamfer 113.

In the illustrated embodiment shown in FIGS. 1A and 1B, the PDC 100 is cylindrical. In such an embodiment, the peripheral region 118 of the leached second region 116 may exhibit a generally ring-shaped geometry, while the non-peripheral region 120 exhibits a generally disk-shaped geometry. However, in other embodiments, the PDC 100 may exhibit other suitable configurations (e.g., triangular, rectangular, elliptical, or other suitable configuration) that may exhibit one or more peripheral surfaces or sides.

When the HPHT sintering pressure is about 7.5 GPa in combination with the precursor average diamond particle size being less than 30 μm, the first region 114 and/or the second leached region 116 (prior to being leached) of the PCD table 102 defined collectively by the bonded diamond grains and the metal-solvent catalyst may exhibit a coercivity of about 115 Oe or more and a metal-solvent catalyst content of less than about 7.5 wt % as indicated by a specific magnetic saturation of about 15 $G{\cdot}cm^3/g$ or less. In a more detailed embodiment, the coercivity may be about 115 Oe to about 250 Oe and the specific magnetic saturation of the first region 114 and/or the second leached region 116 (prior to being leached) may be greater than 0 $G{\cdot}cm^3/g$ to about 15 $G{\cdot}cm^3/g$. In an even more detailed embodiment, the coercivity may be about 115 Oe to about 175 Oe and the specific magnetic saturation of the PCD may be about 5 $G{\cdot}cm^3/g$ to about 15 $G{\cdot}cm^3/g$. In yet an even more detailed embodiment, the coercivity of the first region 114 and/or the second leached region 116 (prior to being leached) may be about 155 Oe to about 175 Oe and the specific magnetic saturation of the first region 114 may be about 10 $G{\cdot}cm^3/g$ to about 15 $G{\cdot}cm^3/g$. The specific permeability (i.e., the ratio of specific magnetic saturation to coercivity) of the PCD may be about 0.10 or less, such as about 0.060 $G{\cdot}cm^3/g{\cdot}Oe$ to about 0.090 $G{\cdot}cm^3/g{\cdot}Oe$. In some embodiments, despite the average grain size of the bonded diamond grains being less than about 30 μm, the metal-solvent catalyst content in the first region 114 and/or the second leached region 116 (prior to being leached) may be less than about 7.5 wt % (e.g., about 3 wt % to about 6 wt % or about 1 wt % to about 3 wt %) resulting in a desirable thermal stability.

The specific magnetic saturation and the coercivity of the first region 114 may be determined by removing the substrate 104 and the leached second region 116 via grinding, lapping, electro-discharge machining, combinations thereof, or another suitable process so that only the first region 114 or only a portion of the first region 114 remains to form a sample region. The sample region may be tested by a number of different techniques to determine the specific magnetic saturation and coercivity. As merely one example, ASTM B886-03 (2008) provides a suitable standard for measuring the specific magnetic saturation and ASTM B887-03 (2008) e1 provides a suitable standard for measuring the coercivity of the sample region. Although both ASTM B886-03 (2008) and ASTM B887-03 (2008) e1 are directed to standards for measuring magnetic properties of cemented carbide materials, either standard may be used to determine the magnetic properties of PCD. A KOERZIMAT CS 1.096 instrument (commercially available from Foerster Instruments of Pittsburgh, Pa.) is one suitable instrument that may be used to measure the specific magnetic saturation and the coercivity of the sample region based on the foregoing ASTM standards.

Figure 2:
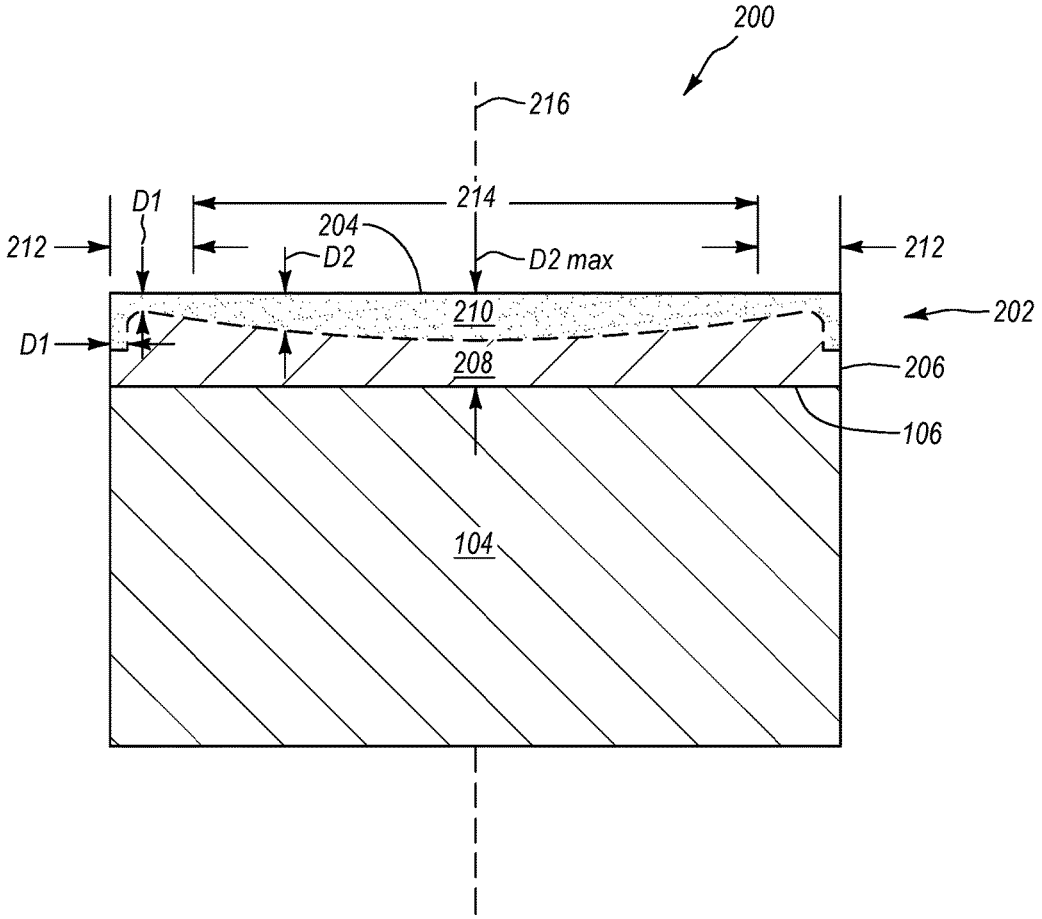
FIG. 2 is a cross-sectional view of another embodiment of a PDC including a PCD table exhibiting a selected leach depth profile.

FIG. 2 is a cross-sectional view of a PDC 200 according to another embodiment. Unlike the PCD table 102 of the PDC 100, a PCD table 202 of the PDC 200 is not chamfered. The PDC 200 includes a substrate 104 having an interfacial surface 106 bonded to the PCD table 202. The PCD table 202 defines a working, upper surface 204 and peripheral surface 206. The upper surface 204 may be planarized via lapping or other suitable planarization process.

The PCD table 202 includes a first region 208 adjacent to the substrate 104 that includes the metal-solvent catalyst infiltrated from the substrate 104 disposed interstitially between the diamond grains. The PCD table 202 further includes a leached second region 210 that has been subjected to a leaching process so that it is depleted of metal-solvent catalyst. The leached second region 210 includes a peripheral region 212 exhibiting a leach depth D1 that is measured from the upper surface 204 and/or the peripheral surface 206. The leached second region 210 further includes a non-peripheral region 214 exhibiting a leach depth D2 that is measured from the upper surface 204. The maximum leach depth for the leach depth D1 is less than the maximum leach depth $D2_{max}$ for the leach depth D2 by about 5 percent to about 60 percent, about 5 percent to about 50 percent, about 25 percent to about 50 percent, about 5 percent to about 15 percent, or about 8 percent to about 12 percent less. The maximum leach depth $D2_{max}$ for the leach depth D2 in the non-peripheral region 214 may be, in some embodiments, generally centrally located as illustrated. The leach depths D1 and D2 may exhibit any of the disclosed ranges discussed above for the leach depths D1 and D2 for the peripheral and non-peripheral regions 118 and 120. Additionally, the first region 208 of the PCD table 202 may exhibit the same or similar magnetic properties as the first region 114 of the PCD table 102 described in FIGS. 1A and 1B.

While the leach depth profile illustrated in FIG. 2 is substantially symmetric about a central axis 216 of the PDC 200 or a plane of symmetry that includes the central axis 216, the leach depth profile may be asymmetric about the central axis 216. For example, the average leach depth D1 and/or D2 on one side of the central axis 122 or the plane of symmetry may be about 5 to about 15 percent less than the average leach depth D1 and/or D2 on the other side of the central axis 122.

In some embodiments, at least a portion of the interstitial regions of the leached second regions 116 and 210 of the PDCs 100 and 200 may be infiltrated with a replacement material in a second HPHT process or a non-HPHT process (e.g., hot isostatic pressing). For example, the replacement material may comprise a nonmetallic diamond catalyst selected from a carbonate (e.g., one or more carbonates of Li, Na, K, Be, Mg, Ca, Sr, and Ba), a sulfate (e.g., one or more sulfates of Be, Mg, Ca, Sr, and Ba), a hydroxide (e.g., one or more hydroxides of Be, Mg, Ca, Sr, and Ba), elemental phosphorous and/or a derivative thereof, a chloride (e.g., one or more chlorides of Li, Na, and K), elemental sulfur, a polycyclic aromatic hydrocarbon (e.g., naphthalene, anthracene, pentacene, perylene, coronene, or combinations of the foregoing) and/or a derivative thereof, a chlorinated hydrocarbon and/or a derivative thereof, a semiconductor material (e.g., germanium or a germanium alloy), and combinations of the foregoing. For example, one suitable carbonate material is an alkali metal carbonate material including a mixture of sodium carbonate, lithium carbonate, and potassium carbonate that form a low-melting ternary eutectic system. This mixture and other suitable alkali metal carbonate materials are disclosed in U.S. patent application Ser. No. 12/185,457, which is incorporated herein, in its entirety, by this reference. The infiltrated alkali metal carbonate material disposed in the interstitial regions of the leached second region may be partially or substantially completely converted to one or more corresponding alkali metal oxides by suitable heat treatment following infiltration.

In another embodiment, the replacement material may comprise a material that is relatively noncatalytic with respect to diamond, such as silicon or a silicon-cobalt alloy. The silicon or a silicon-cobalt alloy may at least partially react with the diamond grains of the leached second region so that it comprises silicon carbide, cobalt carbide, a mixed carbide of cobalt and silicon, combinations of the foregoing and may also include silicon and/or a silicon-cobalt alloy (e.g., cobalt silicide). For example, silicon carbide, cobalt carbide, and/or a mixed carbide of cobalt and silicon are reaction products that may be formed by the replacement material reacting with the diamond grains of the leached second region.

Figure 3A:
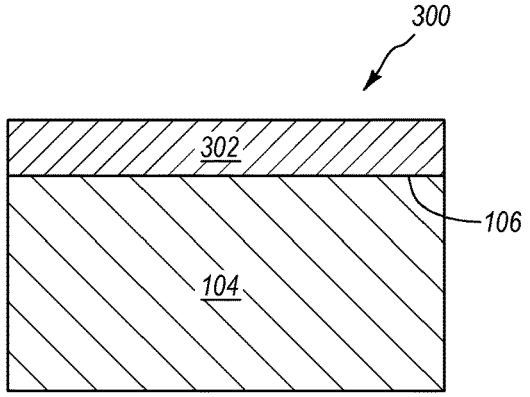
FIGS. 3A-3C are cross-sectional views at different stages during the fabrication of the PDC shown in FIGS. 1A and 1B according to an embodiment of a method.
Figure 3B:
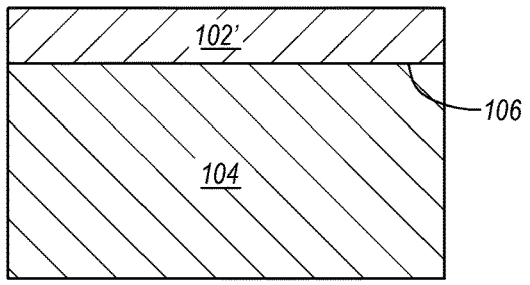
Figure 3C:
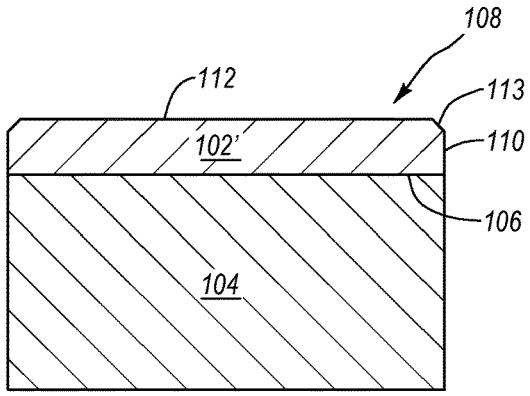

FIGS. 3A-3C are cross-sectional views at different stages during the fabrication of the PDC 100 shown in FIGS. 1A and 1B according to an embodiment of a method. Referring to FIG. 3A, an assembly 300 is formed by disposing one or more layers 302 of diamond particles adjacent to the interfacial surface 106 of the substrate 104. The plurality of diamond particles of the one or more layers 302 of diamond particles may exhibit one or more selected sizes. The one or more selected sizes may be determined, for example, by passing the diamond particles through one or more sizing sieves or by any other method. In an embodiment, the plurality of diamond particles may include a relatively larger size and at least one relatively smaller size. As used herein, the phrases "relatively larger" and "relatively smaller" refer to particle sizes determined by any suitable method, which differ by at least a factor of two (e.g., 40 μm and 20 μm). In various embodiments, the plurality of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In an embodiment, the plurality of diamond particles may include a portion exhibiting a relatively larger size between about 40 μm and about 15 μm and another portion exhibiting a relatively smaller size between about 12 μm and 2 μm. Of course, the plurality of diamond particles may also include three or more different sizes (e.g., one relatively larger size and two or more relatively smaller sizes), without limitation.

In some embodiments, non-diamond carbon, such as graphite particles, fullerenes, other non-diamond carbon, or combinations of the foregoing may be mixed with the plurality of diamond particles. The non-diamond carbon substantially converts to diamond during the HPHT fabrication process discussed in more detail below. The presence of the non-diamond carbon during the fabrication of the PCD table 102 is believed to enhance the diamond density of the PCD table 102 so formed and also result in relative greater non-uniformity in the leach depth profile of the leached second region 116. The non-diamond carbon may be selected to be present in a mixture with the plurality of diamond particles in an amount of about 0.1 wt % to about 20 wt %, such as about 0.1 wt % to about 10 wt %, about 1 wt % to about 9 wt %, about 2 wt % to about 9 wt %, about 3 wt % to about 6 wt %, about 4.5 wt % to about 5.5 wt %, or about 5 wt %. In an embodiment, the non-diamond carbon may be selected to be present in a mixture with the plurality of diamond particles in an amount of about 0.1 wt % to about 0.8 wt %, such as about 0.1 wt % to about 0.50 wt %. The graphite particles employed for the non-diamond carbon may exhibit an average particle size of about 1 μm to about 5 μm (e.g., about 1 μm to about 3 μm) so that the graphite particles may fit into interstitial regions defined by the plurality of diamond particles. According to various embodiments, the graphite particles may be crystalline graphite particles, amorphous graphite particles, synthetic graphite particles, or combinations thereof. The term "amorphous graphite" refers to naturally occurring microcrystalline graphite. Crystalline graphite particles may be naturally occurring or synthetic. Various types of graphite particles are commercially available from Ashbury Graphite Mills of Kittanning, Pa.

The assembly 300 of the substrate 104 and the one or more layers 302 of diamond particles may be placed in a pressure transmitting medium, such as a refractory metal can embedded in pyrophyllite or other pressure transmitting medium. The pressure transmitting medium, including the assembly 300 enclosed therein, may be subjected to an HPHT process using an ultra-high pressure press to create temperature and pressure conditions at which diamond is stable. The temperature of the HPHT process may be at least about 1000° C. (e.g., about 1200° C. to about 1600° C.) and the pressure of the HPHT process may be at least 4.0 GPa (e.g., about 5.0 GPa to about 12 GPa or about 7.5 GPa to about 11 GPa) for a time sufficient to sinter the diamond particles to form a PCD table 102' that is shown in FIG. 3B. For example, the pressure of the HPHT process may be about 8 GPa to about 10 GPa and the temperature of the HPHT process may be about 1150° C. to about 1450° C. (e.g., about 1200° C. to about 1400° C.). Upon cooling from the HPHT process, the PCD table 102' becomes bonded (e.g., metallurgically) to the substrate 104. The foregoing pressure values employed in the HPHT process refer to the pressure in the pressure transmitting medium that transfers the pressure from the ultra-high pressure press to the assembly 300.

During the HPHT process, the metal-solvent catalyst from the substrate 104 may be liquefied and may infiltrate into the diamond particles of the one or more layers 302 of diamond particles. The infiltrated metal-solvent catalyst functions as a catalyst that catalyzes the formation of directly bonded-together diamond grains from the diamond particles to form the PCD table 102'. The PCD table 102' is comprised of a plurality of directly bonded-together diamond grains, with the infiltrated metal-solvent catalyst disposed interstitially between the bonded diamond grains.

Referring to FIG. 3C, the PCD table 102' may be subjected to a planarization process, such as lapping, to planarize an upper surface of the PCD table 102' and form the major surface 112. A grinding process may be used to form the chamfer 113 in the PCD table 102' before or after the planarization process. The peripheral surface 110 may defined by grinding the PCD table 102' using a centerless abrasive grinding process or other suitable process before or after the planarization process and/or forming the chamfer 113. After forming the major surface 112 and the chamfer 113, the PCD table 102' may be leached in a suitable acid to form the leached second region 116 (FIG. 1B) exhibiting a selected leach depth profile, while the un-leached region of the PCD table 102' is represented as the first region 114 in FIG. 1B. For example, the acid may be aqua regia, nitric acid, hydrofluoric acid, or combinations thereof.

Figure 4A:
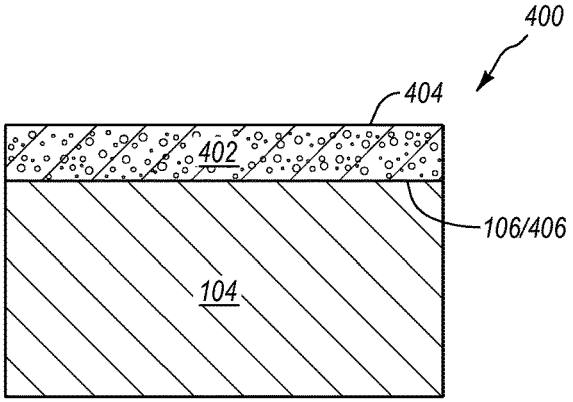
FIGS. 4A-4C are cross-sectional views at different stages during the fabrication of the PDC shown in FIGS. 1A and 1B according to an embodiment of a method.
Figure 4B:
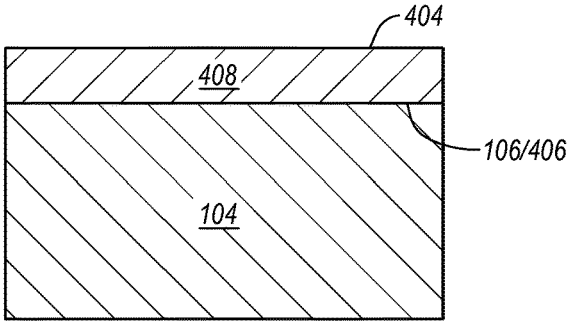
Figure 4C:
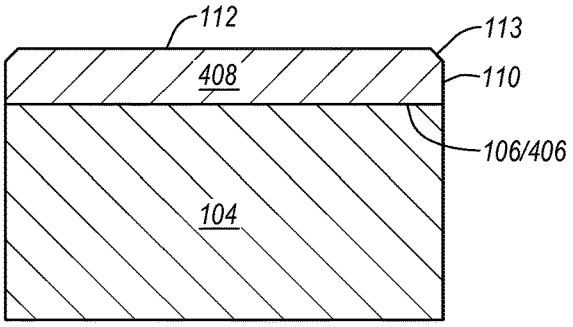

FIGS. 4A-4C are cross-sectional views at different stages during the fabrication of the PDC 100 shown in FIGS. 1A and 1B according to an embodiment of a method for fabricating the PDC 100 that employs a pre-sintered PCD table. Referring to FIG. 4A, an assembly 400 is formed by disposing an at least partially leached PCD table 402 adjacent to the interfacial surface 106 of the substrate 104. The at least partially leached PCD table 402 includes an upper surface 404 and an opposing substrate interfacial surface 406 positioned adjacent to the interfacial surface 106 of the substrate 104. The at least partially leached PCD table 402 includes a plurality of directly bonded-together diamond grains defining interstitial regions that form a network of at least partially interconnected pores that enable fluid to flow from the substrate interfacial surface 406 to the upper surface 404.

The at least partially leached PCD table 402 may be formed by HPHT sintering a plurality of diamond particles (e.g., with or without a substrate) exhibiting any of the disclosed particle size distributions in the presence of a metal-solvent catalyst, and removing at least a portion of or substantially all the metal-solvent catalyst from the sintered PCD body by leaching. The HPHT sintering may be performed using any of the disclosed HPHT process conditions. In some embodiments, any of the disclosed non-diamond carbon materials may be mixed with the plurality of diamond particles in any of the disclosed amounts. For example, the metal-solvent catalyst may be infiltrated into the diamond particles from a metal-solvent catalyst disc (e.g., a cobalt disc), mixed with the diamond particles, infiltrated from a cemented carbide substrate, or combinations of the foregoing. The metal-solvent catalyst may be at least partially removed from the sintered PCD body by immersing the sintered PCD body in an acid, such as aqua regia, nitric acid, hydrofluoric acid, or other suitable acid. For example, the sintered PCD body may be immersed in the acid for about 2 to about 7 days (e.g., about 3, 5, or 7 days) or for a few weeks (e.g., about 4-6 weeks) depending on the process employed to form the at least partially leached PCD table 402.

The assembly 400 may be placed in a pressure transmitting medium, such as a refractory metal can embedded in pyrophyllite or other pressure transmitting medium. The pressure transmitting medium, including the assembly 400 enclosed therein, may be subjected to an HPHT process using an ultra-high pressure press using any of the disclosed HPHT process conditions so that the metal-solvent catalyst from the substrate 104 is liquefied and infiltrates into the interstitial regions of the at least partially leached PCD table 402. For example, the pressure of the HPHT process may be about 5 GPa to about 7 GPa and the temperature of the HPHT process may be about 1150° C. to about 1450° C. (e.g., about 1200° C. to about 1400° C.). Upon cooling from the HPHT process, the infiltrated PCD table represented as PCD table 408 in FIG. 4B becomes bonded to the substrate 104.

Referring to FIG. 4C, the upper surface 404 (FIG. 4B) of the PCD table 408 may be subjected to a planarization process, such as lapping, to form the major surface 112. A relatively more aggressive grinding process may be used to form the chamfer 113 in the PCD table 408 before or after the planarization process. The peripheral surface 110 may be defined in the PCD table 408 using a centerless abrasive grinding process or other suitable process before or after the planarization process and/or forming the chamfer 113. After forming the major surface 112 and the chamfer 113, the PCD table 408 may be leached in a suitable acid to form the leached second region 116 (FIG. 1B) exhibiting a selected leach depth profile, while the un-leached region of the PCD table 408 is represented as the first region 114 in FIG. 1B.

Regardless of whether the PCD table 102 is integrally formed with the substrate 104 or separately formed and bonded to the substrate 104 in a separate HPHT process, a replacement material may be infiltrated into at least a portion of the interstitial regions of the leached second region 116 in a second HPHT process or a non-HPHT process. For example, the replacement material may be disposed adjacent to the upper surface 112 and/or the peripheral surface 110, and infiltrate the interstitial regions of the leached second region 116 during the second HPHT process. According to various embodiments, the replacement material may be selected from a carbonate (e.g., one or more carbonates of Li, Na, K, Be, Mg, Ca, Sr, and Ba), a sulfate (e.g., one or more sulfates of Be, Mg, Ca, Sr, and Ba), a hydroxide (e.g., one or more hydroxides of Be, Mg, Ca, Sr, and Ba), elemental phosphorous and/or a derivative thereof, a chloride (e.g., one or more chlorides of Li, Na, and K), elemental sulfur, a polycyclic aromatic hydrocarbon (e.g., naphthalene, anthracene, pentacene, perylene, coronene, or combinations of the foregoing) and/or a derivative thereof, a chlorinated hydrocarbon and/or a derivative thereof, a semiconductor material (e.g., germanium or a germanium alloy), and combinations of the foregoing. For example, one suitable carbonate material is an alkali metal carbonate material including a mixture of sodium carbonate, lithium carbonate, and potassium carbonate that form a low-melting ternary eutectic system. This mixture and other suitable alkali metal carbonate materials are disclosed in U.S. patent application Ser. No. 12/185,457. The infiltrated alkali metal carbonate material disposed in the interstitial regions of the leached second region 116 may be partially or substantially completely converted to one or more corresponding alkali metal oxides by suitable heat treatment following infiltration.

In another embodiment, the replacement material may comprise silicon or a silicon-cobalt alloy. The replacement material may at least partially react with the diamond grains of the leached second region 116 to form silicon carbide, cobalt carbide, a mixed carbide of cobalt and silicon, or combinations of the foregoing, while unreacted amounts of the replacement material may also remain and include silicon and/or a silicon-cobalt alloy (e.g., cobalt silicide). For example, silicon carbide, cobalt carbide, and/or a mixed carbide of cobalt and silicon are reaction products that may be formed by the replacement material reacting with the diamond grains of the leached second region 116. In an embodiment, the silicon-cobalt replacement material may be present in a layer placed adjacent to the upper surface 112, which includes silicon particles present in an amount of about 50 to about 60 wt % and cobalt particles present in an amount of about 40 to about 50 wt %. In a more specific embodiment, the layer includes silicon particles and cobalt particles present in an amount of about equal to or near a eutectic composition of the silicon-cobalt chemical system. In some embodiments, the silicon particles and cobalt particles may be held together by an organic binder to form a green layer of cobalt and silicon particles. In another embodiment, the layer may comprise a thin sheet of a silicon-cobalt alloy or a green layer of silicon-cobalt alloy particles formed by mechanical alloying having a low-melting eutectic or near eutectic composition.

Figure 5:
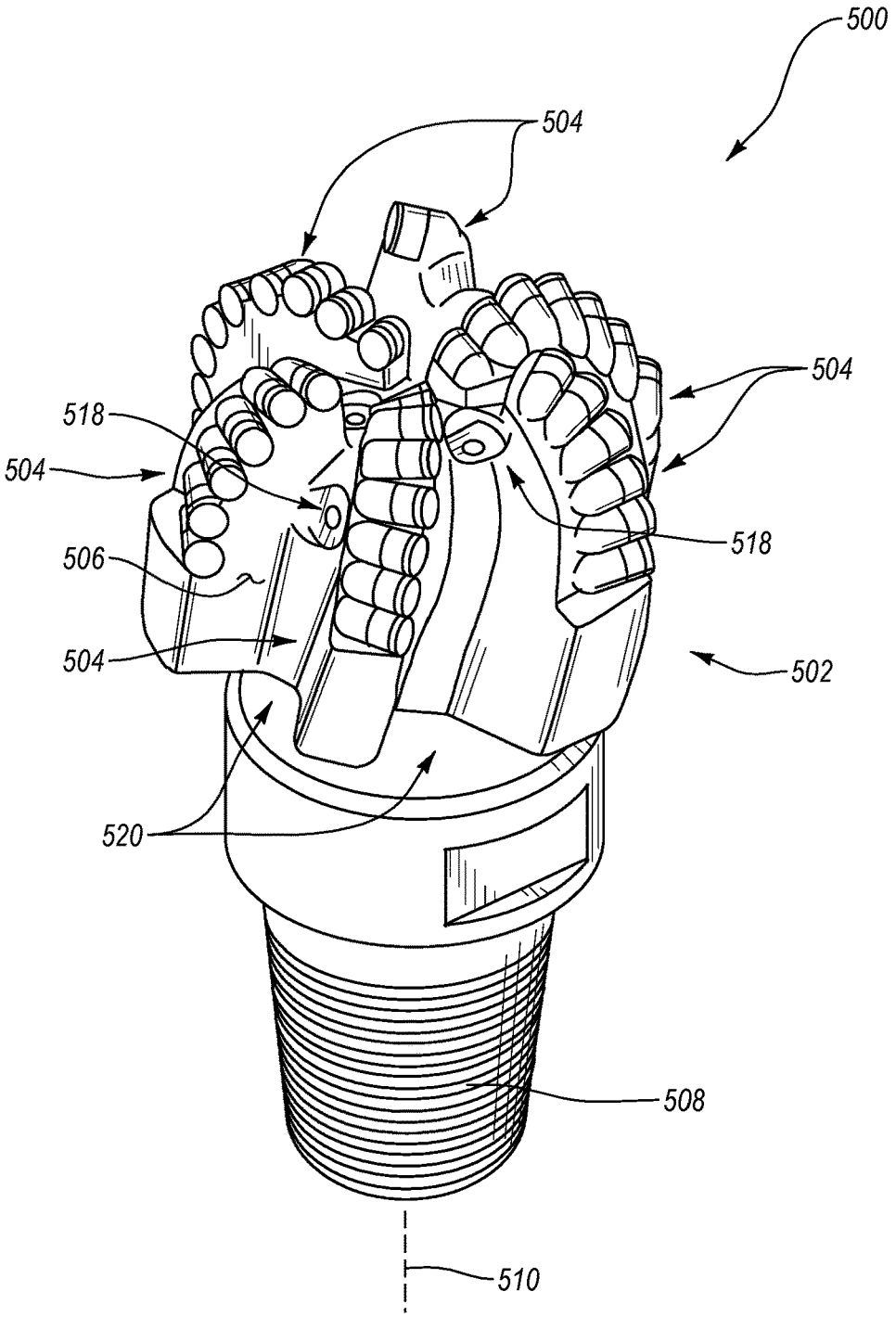
FIG. 5 is an isometric view of an embodiment of a rotary drill bit that may employ one or more of the disclosed PDC embodiments.
Figure 6:
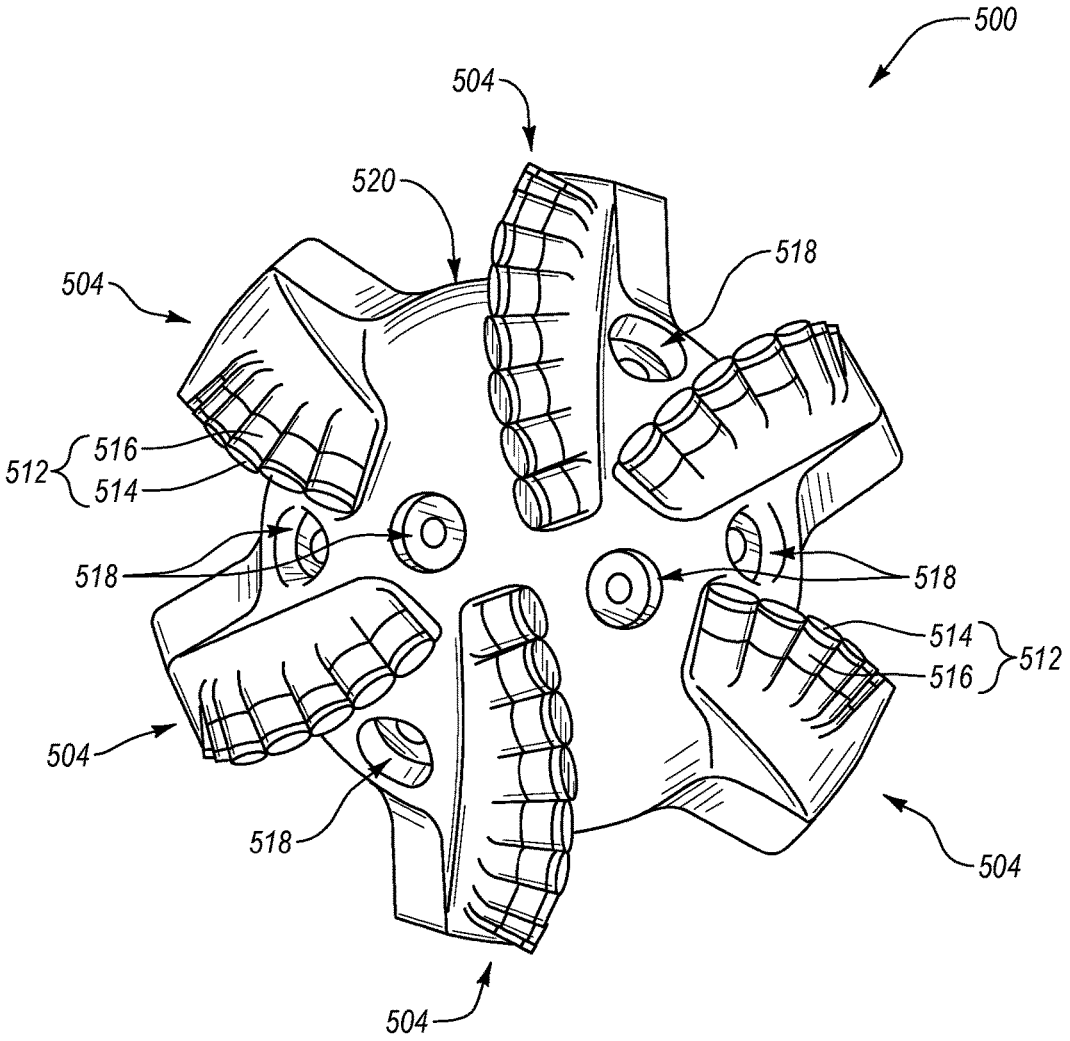
FIG. 6 is a top elevation view of the rotary drill bit shown in FIG. 5.

FIG. 5 is an isometric view and FIG. 6 is a top elevation view of an embodiment of a rotary drill bit 500 that includes at least one PDC configured according to any of the disclosed PDC embodiments. The rotary drill bit 500 comprises a bit body 502 that includes radially and longitudinally extending blades 504 having leading faces 506, and a threaded pin connection 508 for connecting the bit body 502 to a drilling string. The bit body 502 defines a leading end structure for drilling into a subterranean formation by rotation about a longitudinal axis 510 and application of weight-on-bit. At least one PDC, configured and fabricated according to any of the disclosed PDC embodiments, may be affixed to the bit body 502. With reference to FIG. 6, a plurality of PDCs 512 are secured to the blades 504 of the bit body 502 (FIG. 5). For example, each PDC 512 may include a PCD table 514 bonded to a substrate 516. More generally, the PDCs 512 may comprise any PDC disclosed herein, without limitation. In addition, if desired, in some embodiments, a number of the PDCs 512 may be conventional in construction. Also, circumferentially adjacent blades 504 define so-called junk slots 520 therebetween. Additionally, the rotary drill bit 500 includes a plurality of nozzle cavities 518 for communicating drilling fluid from the interior of the rotary drill bit 500 to the PDCs 512.

FIGS. 5 and 6 merely depict one embodiment of a rotary drill bit that employs at least one PDC fabricated and structured in accordance with the disclosed embodiments, without limitation. The rotary drill bit 500 is used to represent any number of earth-boring tools or drilling tools, including, for example, core bits, roller-cone bits, fixed-cutter bits, eccentric bits, bi-center bits, reamers, reamer wings, or any other downhole tool including superabrasive compacts, without limitation.

The PDCs disclosed herein (e.g., PDC 100 of FIGS. 1A and 1B) may also be utilized in applications other than cutting technology. For example, the disclosed PDC embodiments may be used in wire dies, bearings, artificial joints, inserts, cutting elements, and heat sinks. Thus, any of the PDCs disclosed herein may be employed in an article of manufacture including at least one superabrasive element or compact.

Thus, the embodiments of PDCs disclosed herein may be used in any apparatus or structure in which at least one conventional PDC is typically used. In one embodiment, a rotor and a stator, assembled to form a thrust-bearing apparatus, may each include one or more PDCs (e.g., PDC 100 of FIGS. 1A and 1B) configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing PDCs disclosed herein may be incorporated. The embodiments of PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the PDCs disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,460,233; 5,544,713; and 6,793,681, the disclosure of each of which is incorporated herein, in its entirety, by this reference.

The following working example provides further detail in connection with some of the specific PDC embodiments described above.

Working Example

Two PDCs were formed according to the following process. Two PCD tables were each formed by HPHT sintering, in the presence of cobalt, diamond particles having an average grain size of about 19 μm. Each PCD table included directly bonded-together diamond grains, with cobalt disposed within interstitial regions between the bonded-together diamond grains. Each PCD table was leached with acid for a time sufficient to remove substantially all of the cobalt from the interstitial regions to form an at least partially leached PCD table. Each at least partially leached PCD table was placed adjacent to a respective cobalt-cemented tungsten carbide substrate, and HPHT processed in a high-pressure cubic press at a temperature of about 1400° C. and a pressure of about 5 GPa to about 7 GPa to form a PDC comprising a re-infiltrated PCD table bonded to the cobalt-cemented tungsten carbide substrate. Cobalt from the cobalt-cemented tungsten carbide substrate re-infiltrated the at least partially leached PCD table during the HPHT process.

The re-infiltrated PCD table of each PDC was lapped to planarize an upper surface thereof. After lapping, the re-infiltrated PCD table was ground to form a chamfer therein. After forming the chamfer, the periphery of the re-infiltrated PCD table was centerless ground. After lapping and grinding, the re-infiltrated PCD table of each PDC was leached in an acid for about 3 days to remove cobalt from an upper region of the re-infiltrated PCD table. Scanning electron microscopy was performed on each leached PDC and it was determined that the leached depth was less near the chamfer and the side surface of the PCD table than the leach depth at or near the central axis of the PCD table. Scanning electron microscopy of the first leached PCD table was performed. The leach depth of the leached PCD table of the first PDC was between about 461 μm and about 474 μm in a non-peripheral region measured from the lapped upper surface, and the leach depth was between about 115 μm and about 171 μm in a peripheral region measured inwardly from the chamfer and the side surface. Scanning electron microscopy of the leached PCD table of the second PDC was also performed. The leach depth of the leached PCD table of the second PDC was between about 394 μm and about 408 μm in a non-peripheral region measured from the lapped upper surface, and the leach depth was between about 128 μm and about 183 μm in a peripheral region measured inwardly from the chamfer and the side surface.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A method of fabricating a leached polycrystalline diamond compact, the method comprising:

providing a polycrystalline diamond compact including:

a substrate; and a polycrystalline diamond table bonded to the substrate, the polycrystalline diamond table defining an upper surface, at least one peripheral surface, and a chamfer extending between the upper surface and the at least one peripheral surface, the polycrystalline diamond table including a plurality of bonded diamond grains defining a plurality of interstitial regions, the polycrystalline diamond table further including a metallic constituent disposed interstitially between at least some of the plurality of bonded diamond grains thereof; and leaching a region of the polycrystalline diamond table to deplete the region of the metallic constituent to form a leached region;

wherein the leached region includes:

a first portion having a first leach depth, the first portion adjacent to at least part of the chamfer; and a second portion having a second leach depth that is different than the first leach depth, the second portion extending along and adjacent to at least part of the at least one peripheral surface.

2. The method of claim 1, wherein the first leach depth is greater than the second leach depth.

3. The method of claim 1, wherein the first leach depth is about 300 μm to about 425 μm, and the second leach depth is about 150 μm to about 225 μm.

4. The method of claim 1, wherein leaching a region of the polycrystalline diamond table to deplete the region of the metallic constituent includes leaching the region effective to form the leached region with a leach depth profile having a maximum leach depth that is at least about 300 μm as measured from the upper surface in the first portion, a leach depth of the leach depth profile decreasing with lateral distance from a central axis of the polycrystalline diamond table and toward the at least one peripheral surface.

5. The method of claim 4, wherein the leach depth of the leached region decreases discontinuously with lateral distance from the central axis of the polycrystalline diamond table and toward the at least one peripheral surface.

6. The method of claim 4, wherein the leach depth profile of the leached region is asymmetric or substantially symmetric about the central axis of the polycrystalline diamond table.

7. The method of claim 4, wherein the leach depth of the leached region decreases substantially continuously with lateral distance from the central axis of the polycrystalline diamond table and toward the at least one peripheral surface.

8. The method of claim 4, wherein the maximum leach depth is about 300 μm to about 425 μm.

9. The method of claim 1, wherein the second leach depth in the second portion of the leached region is about 5% to about 50% less than the first leach depth in the first portion of the leached region.

10. The method of claim 1, wherein the second leach depth in the second portion of the leached region is about 8% to about 12% less than the first leach depth in the first portion of the leached region.

11. The method of claim 1, wherein the polycrystalline diamond table is integrally formed with the substrate.

12. The method of claim 1, wherein the polycrystalline diamond table is preformed and bonded to the substrate.

13. The method of claim 1, wherein, prior to leaching, the polycrystalline diamond table exhibits a coercivity of about 115 Oe to about 250 Oe and a specific magnetic saturation greater than 0 $G \cdot cm^3/g$ to about 15 $G \cdot cm^3/g$.

14. The method of claim 1, wherein, prior to leaching, the polycrystalline diamond table exhibits a coercivity of about 155 Oe to about 175 Oe and a specific magnetic saturation greater than 10 $G \cdot cm^3/g$ to about 15 $G \cdot cm^3/g$.

15. The method of claim 1, wherein the plurality of bonded diamond grains exhibits an average grain size of about 30 μm or less, and wherein, prior to leaching, the metallic constituent is less than about 7.5 weight % of the first region.

16. The method of claim 1, wherein, prior to leaching, the metallic constituent is less than about 1 weight % to about 6 weight % of the first region.

17. The method of claim 16, wherein, prior to leaching, the metallic constituent is less than about 1 weight % to about 3 weight % of the first region.

18. The method of claim 1, wherein the metallic constituent includes at least one of a metal-solvent catalyst or a metallic infiltrant.

19. The method of claim 1, wherein the region extends inwardly from the upper surface, the chamfer, and the at least one peripheral surface.

20. A method of fabricating a leached polycrystalline diamond compact, the method comprising:

providing a polycrystalline diamond compact including:

a substrate; and a polycrystalline diamond table bonded to the substrate, the polycrystalline diamond table defining an upper surface, at least one peripheral surface, and a chamfer extending between the upper surface and the at least one peripheral surface, the polycrystalline diamond table including a plurality of bonded diamond grains defining a plurality of interstitial regions, the polycrystalline diamond table further including a metallic constituent disposed interstitially between at least some of the plurality of bonded diamond grains thereof; and leaching a region of the polycrystalline diamond table to deplete the region of the metallic constituent to form a leached region;

wherein the leached region includes:

a first portion having a first leach depth, the first portion near the chamfer; and a second portion having a second leach depth that is different than the first leach depth, the second portion adjacent to at least a part of the at least one peripheral surface.

21. The method of claim 20, wherein the first leach depth is greater than the second leach depth.

22. The method of claim 20, wherein the first leach depth is about 300 μm to about 425 μm, and the second leach depth is about 150 μm to about 225 μm.

23. The method of claim 20, wherein the second leach depth in the second portion of the leached region is about 5% to about 50% less than the first leach depth in the first portion of the leached region.

24. The method of claim 20, wherein the first portion of the leached region is adjacent to the chamfer.

25. The method of claim 20, wherein the first portion of the leached region is spaced from the chamfer.

26. The method of claim 20, wherein the second portion of the leached region extends along the at least one peripheral surface.

27. The method of claim 20, wherein the region extends inwardly from the upper surface, the chamfer, and the at least one peripheral surface.

28. A method of fabricating a leached polycrystalline diamond compact, the method comprising:

forming a polycrystalline diamond compact including a substrate bonded to a polycrystalline diamond table, the polycrystalline diamond table including an upper surface, at least one peripheral surface, a metallic constituent disposed insterstitially between a plurality of diamond grains;

forming a chamfer on the polycrystalline diamond table between the upper surface and the at least one peripheral surface; and leaching a region of the polycrystalline diamond table to deplete the region of the metallic constituent to form a leached region;

wherein the leached region includes:

a first portion having a first leach depth, the first portion adjacent to at least part of the chamfer; and a second portion having a second leach depth that is different than the first leach depth, the second portion extending along and adjacent to at least part of the at least one peripheral surface.

29. The method of claim 28, further comprising, before forming the chamfer on the polycrystalline diamond table, lapping the polycrystalline diamond table to planarize the upper surface.

30. The method of claim 28, wherein forming a chamfer on the polycrystalline diamond table between the upper surface and the at least one peripheral surface includes grinding the polycrystalline diamond table.

31. The method of claim 28, wherein the first leach depth is about 300 μm to about 425 μm, and the second leach depth is about 150 μm to about 225 μm.

32. The method of claim 28, wherein the second leach depth in the second portion of the leached region is about 5% to about 50% less than the first leach depth in the first portion of the leached region.

33. The method of claim 28, wherein the region extends inwardly from the upper surface, the chamfer, and the at least one peripheral surface.

* * * * *